US005275378A

United States Patent [19]

Alten

[11] Patent Number: 5,275,378

[45] Date of Patent: Jan. 4, 1994

[54] AUTOMOTIVE JACK

[75] Inventor: Ferdinand Alten, Mandern, Fed. Rep. of Germany

[73] Assignee: August Bilstein GmbH & Co. KG, Ennepetal, Fed. Rep. of Germany

[21] Appl. No.: 790,226

[22] Filed: Nov. 8, 1991

[30] Foreign Application Priority Data

Nov. 20, 1990 [DE] Fed. Rep. of Germany ..... 9015832

[51] Int. Cl.[5] ..... B66F 3/00

[52] U.S. Cl. ..... 254/126; 254/7 R; 124; 254/124

[58] Field of Search ..... 254/2 R, 7R,B,C, 9B, 98, 122, 124, 126, 129

[56] References Cited

U.S. PATENT DOCUMENTS 3,989,225 11/1976 Keilholz ..... 254/126
4,093,182 6/1978 Rutenback ..... 254/126
4,475,373 10/1984 Ikenberry ..... 254/124
4,765,595 9/1988 Alten ..... 254/126
4,848,733 7/1989 Yamauchi et al. ..... 254/126

*Primary Examiner*—Bruce M. Kisliuk
*Assistant Examiner*—E. Morgan
*Attorney, Agent, or Firm*—Max Fogiel

[57] ABSTRACT

An automotive jack in which an upright leg is provided with a U-shaped cross-section and has a foot connected to an end of that leg. A supporting arm is connected to the leg at a pivot with a horizontal axis, whereby the supporting arm is pivotable about the horizontal axis. The jack is actuated through a thread and nut device which is pivotally connected to the leg and the supporting arm. The U-shaped cross-section of the leg has an open end and two sides connected by a convex base portion in the cross-section of the leg and throughout substantially the length of the leg when viewed from outside the leg.

4 Claims, 2 Drawing Sheets

AUTOMOTIVE JACK

BACKGROUND OF THE INVENTION

Such jacks are needed preferably to lift automobiles in the event of a breakdown in order to replace a defective wheel with a spare.

German AS 2 444 132 discloses such a jack. It has an upright leg and a supporting arm that pivots around a horizontal axis. The leg and the arm pivot toward each other subject to an activating mechanism that attaches directly to each. The leg and supporting arm in this jack are lengths of structural metal U section. The sides of both the leg and the arm section are secured to its base at a right angle, leaving a rather sharp edge.

SUMMARY OF THE INVENTION

The object of the invention is accordingly to improve the aforesaid jack by rendering it lighter in weight.

The major advantage of the invention is that the jack, although it can bear the same load, does not weigh as much. It also requires less space to stow.

BRIEF DESCRIPTION OF THE DRAWINGS

One embodiment of the invention will now be described in greater detail with reference to the accompanying drawing, wherein.

DESCRIPTION OF THE PREFERRED EMBODIMENTS

Figure 1:
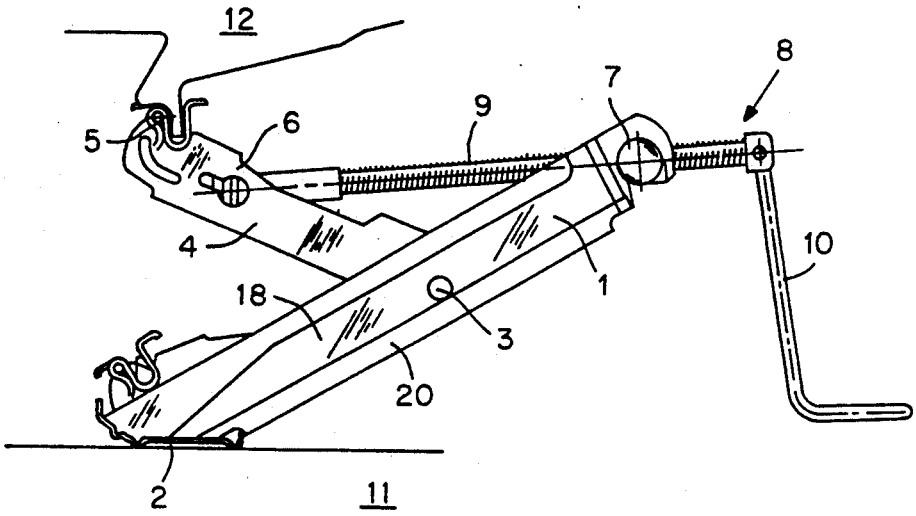
FIG. 1 illustrates a one-armed jack with an activating mechanism attached directly to the leg and the supporting arm, FIG. 2 a similar jack with an activating mechanism attached at one end to the leg and the supporting arm by way of a parallelogram.

The jack has a leg 1 with a foot 2 at the bottom. A supporting arm 4 pivots around a horizontal axis 3 on leg 1. At the top of the arm is a load-interception plate 5. An activating mechanism 8 is directly attached to supporting arm 4 at a point 6 of articulation and to leg 1 at a point 7 of articulation. The activating mechanism 8 in the illustrated embodiment is a threaded shaft 9 that operates in conjunction with a nut at the point 7 of articulation on leg 1. Shaft 9 is rotated with a manually operated crank 10. Foot 2 rests against ground 11 and the plate 5 on supporting arm 4 engages the bottom of the vehicle 12 being lifted.

Figure 2:
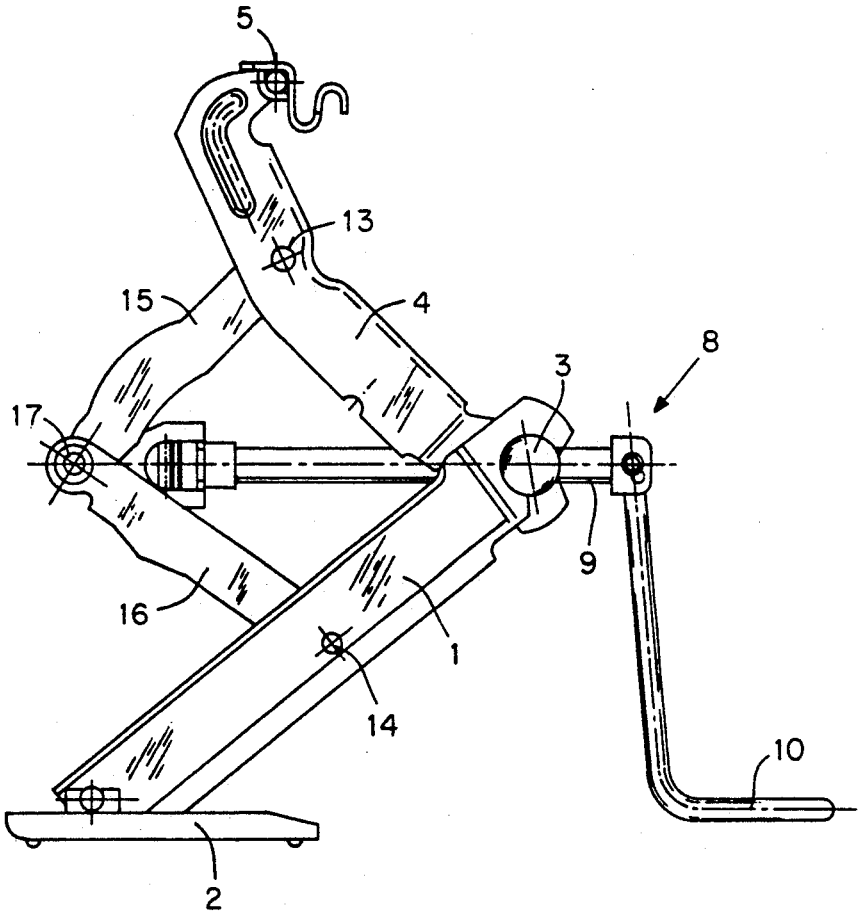

FIG. 2 illustrates another embodiment of the jack in accordance with the invention. It also comprises an upright leg 1 with a foot 2 and a supporting arm 4 with a plate 5 that pivot together around a horizontal axis 3. Two connecting arms 15 and 16 constitute a parallelogram in conjunction with supporting arm 4 and foot 2. The activating mechanism in this embodiment is attached at the interior angle 17 of flection between connecting arms 15 and 16 and to axis 3. The mechanism is again a threaded shaft 9 with a manually operated crank 10 that adjusts the jack in conjunction with a nut, which is situated at axis 3 in the present case.

Figure 3:
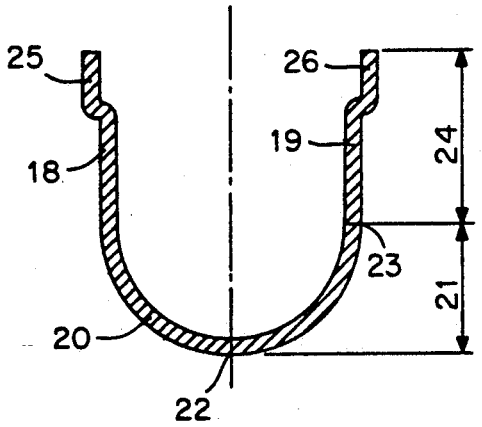
FIGS. 3 to 5 are sectional views of three different embodiments of the cross-section of the leg.
Figure 4:
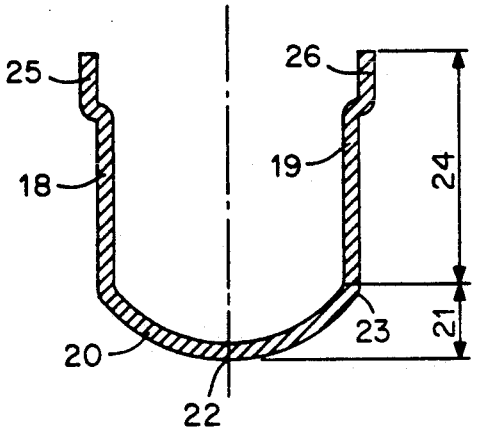
Figure 5:
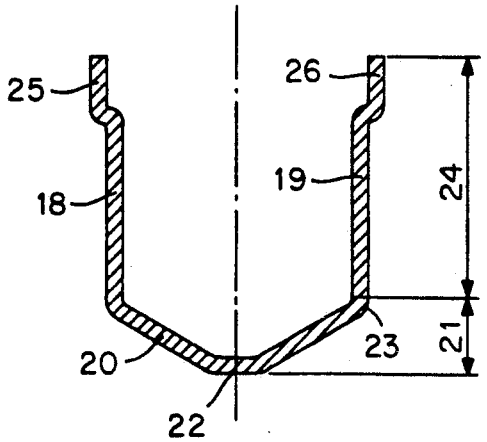

FIGS. 3 to 5 illustrates three different types of structural section for leg 1. The cross-sections constitute sides 18 and 19 and a base 20. Each base is convex. The distance 21 from the midpoint 22 of base 20 to the transition 23 to a side 18 or 19 is at least 20% of the length 24 of the side. Each side is reinforced with a bead 25 and 26 along its edge. The base of the section illustrated in FIG. 3 is semicircular, that of the section illustrated in FIG. 4 is arched, and that of the section illustrated in FIG. 5 gabled with a flattened peak.

I claim:

1. An automotive jack comprising: an upright leg having a U-shaped cross-section; a foot connected to an end of said leg; said leg having a pivot with a horizontal axis; a supporting arm with an end portion connected to said pivot and being pivotable about said horizontal axis; actuating means connected pivotally to said leg and said arm; said U-shaped cross-section of said leg having an open end and two sides connected by a convex base portion, said base portion being convex in said cross-section throughout substantially the length of said leg when viewed from outside said leg.

2. An automotive jack as defined in claim 1, wherein said convex base portion connects with said sides at transitional sections, said sides having a length, said convex base portion having a mid-point spaced from said sides by substantially 20% of said length of said sides.

3. An automotive jack as defined in claim 1, wherein said sides in cross-section are comprised of first walls connecting to said convex base portion, and second walls adjacent said open end; transitional portions connecting said first walls to said second walls, spacing between said second walls being greater than spacing between said first walls.

4. An automotive jack comprising: an upright leg having a U-shaped cross-section; a foot connected to an end of said leg; said leg having a pivot with a horizontal axis; a supporting arm with an end portion connected to said pivot and being pivotable about said horizontal axis; actuating means connected pivotally to said leg and said arm; said U-shaped cross-section of said leg having an open end and two sides connected by a convex base portion at predetermined intervals along a length of said leg, said base portion being convex in said cross-section only at predetermined intervals along the length of said leg when viewed from outside said leg.

* * * * *